US005911499A

United States Patent [19]

Stafford et al.

[11] Patent Number: 5,911,499

[45] Date of Patent: Jun. 15, 1999

[54] EMERGENCY LIGHTING FIXTURE, ESPECIALLY FOR HAZARDOUS LOCATIONS

[75] Inventors: Stephen M. Stafford, Radford, Va.; Michael A. Kurtz, Belleville, Ill.

[73] Assignee: Hubbell Incorporated, Orange, Conn.

[21] Appl. No.: 08/531,836

[22] Filed: Sep. 21, 1995

[51] Int. Cl.[6] ..... F21S 9/00

[52] U.S. Cl. ..... 362/240; 362/20; 362/35; 362/147

[58] Field of Search ..... 362/20, 147, 267, 362/276, 227, 240, 35

[56] References Cited

U.S. PATENT DOCUMENTS

| | | | |
|---|---|---|---|
| 2,345,382 | 3/1944 | Cramer | 362/35 |
| 2,762,994 | 9/1956 | Kennelly | 362/35 |
| 2,770,715 | 11/1956 | Stecher | 362/267 |
| 3,328,573 | 6/1967 | Nava et al. | 362/267 |
| 3,479,498 | 11/1969 | Lasseigne | 240/2 |
| 4,071,749 | 1/1978 | Balogh | 362/20 |
| 4,142,179 | 2/1979 | Lowndes | 362/363 |
| 4,156,891 | 5/1979 | Roche | 362/20 |
| 4,177,500 | 12/1979 | Nicholl et al. | 362/183 |
| 4,255,746 | 3/1981 | Johnson et al. | 340/577 |
| 4,302,800 | 11/1981 | Pelletier | 362/250 |
| 4,388,681 | 6/1983 | Meyer | 362/267 |
| 4,425,609 | 1/1984 | Grindle | 362/267 |
| 4,571,531 | 2/1986 | Lin | 362/183 |
| 4,600,972 | 7/1986 | MacIntyre | 362/183 |
| 4,605,993 | 8/1986 | Zelina, Jr. | 362/183 |
| 4,802,065 | 1/1989 | Minter et al. | 362/20 |
| 5,010,454 | 4/1991 | Hopper | 362/61 |
| 5,365,145 | 11/1994 | Fields | 362/183 |
| 5,379,195 | 1/1995 | Epstein | 362/20 |
| 5,412,552 | 5/1995 | Fernandes | 362/250 |
| 5,499,167 | 3/1996 | Brown | 362/35 |
| 5,580,148 | 12/1996 | Liao | 362/35 |
| 5,584,560 | 12/1996 | Gosswiller et al. | 362/35 |
| 5,649,761 | 7/1997 | Sandell et al. | 362/276 |
| 5,673,989 | 10/1997 | Gohl et al. | 362/35 |

OTHER PUBLICATIONS

Dual Lite Brochure, "Explosion Proof Series" (date unknown).

Exide lightguard Brochure, "Explosion Proof emergency Lighting Units", Oct. 1993.

Cooper Lighting Brochure, "HZU–1254 Series" (date unknown).

Crouse–Hinds ECM Brochure, "Light–Pak N2LPS", Jan. 1992.

*Primary Examiner*—Laura Tso

*Attorney, Agent, or Firm*—Jerry M. Presson; David L. Tarnoff; Thomas P. Hilliard

[57] ABSTRACT

An emergency lighting fixture with backup battery power for illuminating aimable lamps or a plurality of lamps mounted in a single housing in response to loss of power. In the preferred embodiment, the lighting fixture has three independently adjustable lamps mounted within a single housing. The lamps are adjustable about vertical and horizontal axes for maximum aiming capabilities. The housing is preferably an explosion proof housing with a glass globe for mounting in hazardous locations or areas. The glass globe allows the lamps to be aimed through 360° so that light transmitted by the lamps can be aimed to a specific area adjacent the lighting fixture. The lighting fixture also preferably has its backup batteries mounted within the housing along with a charger for maintaining the batteries at full charge.

41 Claims, 7 Drawing Sheets

EMERGENCY LIGHTING FIXTURE, ESPECIALLY FOR HAZARDOUS LOCATIONS

FIELD OF THE INVENTION

This invention generally relates to emergency lighting fixtures for illuminating hazardous locations in response to loss of power in the hazardous location. More particular, this invention relates to a lighting fixture having an explosion proof housing with at least one high intensity lamp mounted therein, which can be independently adjusted both horizontally and vertically for aiming the light emitted therefrom to a specific area.

BACKGROUND OF THE INVENTION

Typically, emergency lighting fixtures are required by municipal, state or federal codes to illuminate workers exit routes such as doorways, hallways, aisles, stairs, ramps and passageways leading to an exit. Emergency lighting fixtures are also used in areas containing critical instruments equipment and processes to provide stand by and safety lighting.

Presently, many different types of emergency lighting fixtures exist for providing light to an area in the event of loss of power. For example, some emergency lighting fixtures utilize small boxes with a pair of externally mounted lamps. These types of emergency lighting fixtures are mounted on walls and often used in hallways and stairwells of buildings. Another type of emergency lighting fixture utilizes a centrally located control box with backup batteries and a plurality of remotely located lamps electrically coupled thereto. Other emergency lighting fixtures utilize a single lamp located within a housing which also includes backup batteries.

Depending upon the construction of the emergency lighting fixture, it may be limited to use in certain types of areas. More specifically, government regulations and codes dictate the type of emergency lighting which can be utilized in certain types of areas or environments. This is especially the case in areas or environments containing ignitable materials in which a spark generated by the lighting fixture could cause the materials to ignite or even explode. Accordingly, emergency lighting fixtures for use in hazardous locations are required to meet various governmental standards to prevent fires and/or explosions from occurring due to the lighting fixture.

Many emergency lighting fixtures are currently available on the market for use in hazardous areas or locations. Typically, they are either stand alone fixtures with backup batteries, a charger and a single lamp mounted within an explosion proof housing or a plurality of lamp fixtures mounted in individual explosion proof housings with remotely mounted backup batteries and charger. However, these prior art emergency lighting fixtures suffer from many deficiencies. For example, the stand alone fixtures with an internal light source only have a single non-directional lamp mounted within the housing. Accordingly, the light transmitted by such stand lone unit cannot be directed or aimed to a particular location with the area or location it is mounted.

Emergency lighting fixtures, which have a plurality of lamps, on the other hand, require separate explosion proof housings for each of the lamps. This can be expensive to manufacture.

Examples of some various emergency lighting fixtures known in the prior art are disclosed in U.S. Pat. Nos. 4,255,746 to Johnson et al; 4,802,065 to Minter et al; and 5,379, to Epstein. Examples of some lighting arrangements with directional lamps are disclosed in U.S. Pat. Nos. 3,479,498 to Lasseigne; 4,302,800 to Pelletier; and 5,010, 454 to Hopper.

In view of the above, it will become apparent to those skilled in the art that there exists a need for an emergency lighting fixture with one or more aimable lamps mounted within a single housing as well as a need for an emergency lighting fixture with a plurality of lamps mounted within a single housing. Accordingly, this invention addresses these needs in the art along with other needs which will become apparent to those skilled in the art once given this disclosure.

SUMMARY OF THE INVENTION

One object of the present invention is to provide an emergency lighting fixture with an internal lamp which is aimable.

Another object of the present invention is to provide an emergency lighting fixture with a plurality of lamps mounted within a single enclosure.

Still another object of the present invention is to provide an emergency lighting fixture with independently adjustable lamps mounted with an enclosure for aiming each lamp in both the horizontal and vertical directions.

Yet another object of the present invention is to provide an emergency lighting fixture with an explosion proof housing including a transparent globe for aiming an internal lamp through 360° in the horizontal direction.

Another object of the present invention is to provide an emergency lighting fixture of the explosion proof type which is relatively inexpensive to manufacture and relatively easy to assemble.

The foregoing objects are basically attained by providing an emergency lighting fixture for providing light in response to loss of power, comprising: a housing with a transparent section for allowing light to pass therethrough, and mounting structure to mounting the housing to a support; a first lamp movably mounted within the housing for adjustably aiming light transmitted by the first lamp through the transparent section of the housing and towards a specific external area; and a power storage unit with emergency backup power stored therein for energizing the lamp in response to the loss of power being electrically coupled to the first lamp and adapted to be electrically coupled to an external power source.

The foregoing objects are also basically attained by providing an emergency lighting fixture for providing light in the event of loss of power, comprising: a housing with a transparent section for allowing light to pass therethrough, and mounting structure to mount the housing to a support; a plurality of lamps mounted within the housing for transmitting light through the transparent section of the housing to illuminate specific external areas; and a power storage unit electrically coupled to the lamps for supplying emergency backup power thereto, and adapted to be electrically coupled to an external power supply to detect the loss of power being transmitted to the power storage unit.

Other objects, advantages and salient features of the present invention will become apparent to those skilled in the art from the following detailed description, which, taken in conjunction with the annexed drawings discloses preferred embodiments of the present invention.

BRIEF DESCRIPTION OF THE DRAWINGS

Referring now to the drawings which form part of this original disclosure.

DETAILED DESCRIPTION OF THE DRAWINGS

Figure 1:
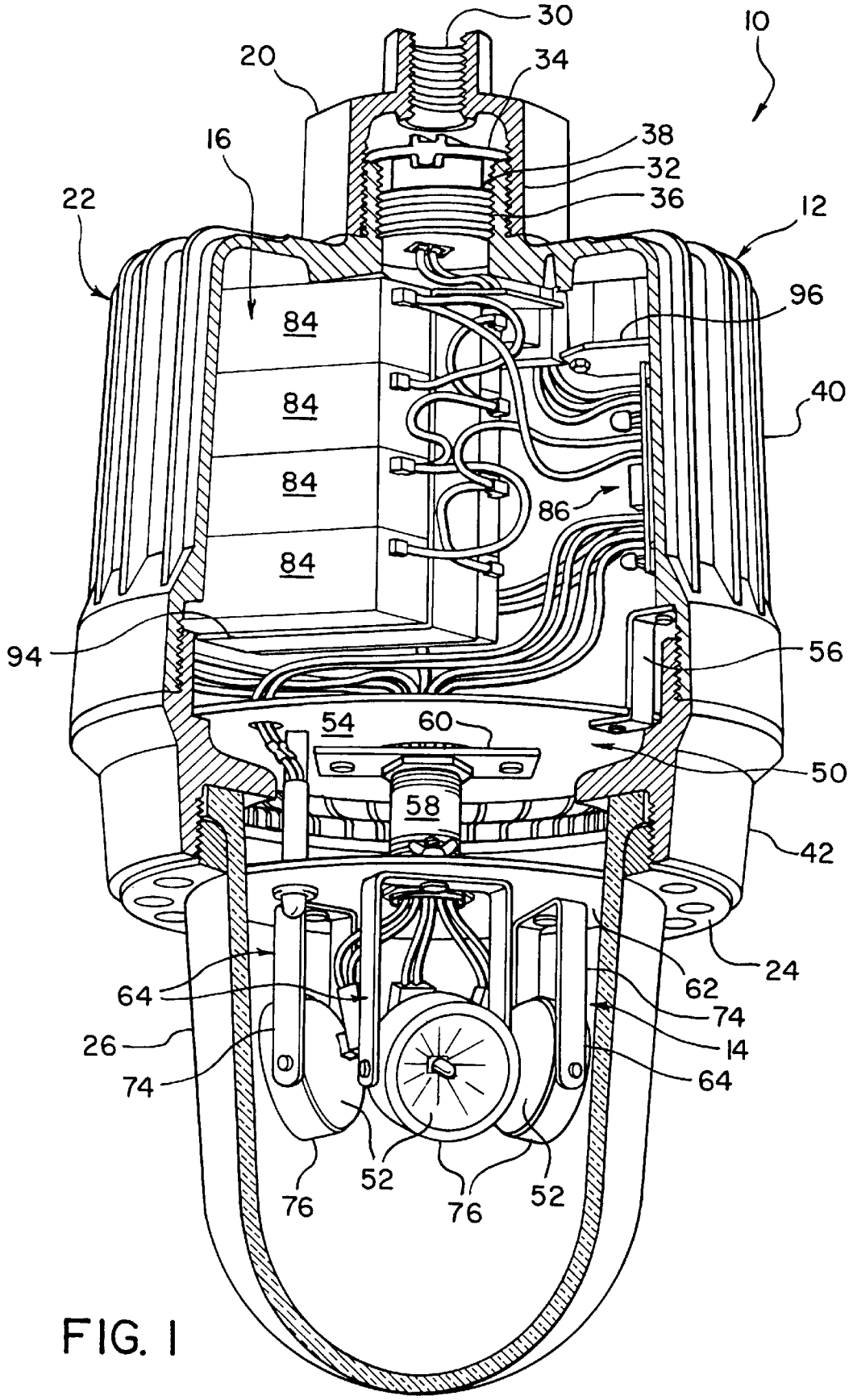
FIG. 1 is a perspective view of the emergency lighting fixture in accordance with the present invention with portions of its housing broken away and certain parts removed to illustrate the power storage unit and the lamp unit.

Referring initially to FIGS. 1–4, an emergency lighting fixture 10 in accordance with the present invention is illustrated. Emergency lighting fixture 10 is specially designed for use in hazardous locations or areas, and includes an explosion proof housing 12, a lamp unit 14, a power storage unit 16 and an optional remote test station 18. Emergency lighting fixture 10 is designed to be a stand alone unit, which can be mounted in a variety of ways such as a pendant type mounting, a 90° wall bracket mounting or a ceiling mounting. These types of mountings are well known in the art, and thus, will not be discussed in detail herein.

Emergency lighting fixture 10, as discussed below, is designed to provide emergency battery backup light to illuminated areas adjacent thereto in the event of power loss in the area. In particular, emergency lighting fixture 10 is connected to an external power source for sensing loss of power in the external power source, which in turn causes power storage unit 16 to illuminate lamp unit 14 upon sensing a loss of power.

Figure 2:
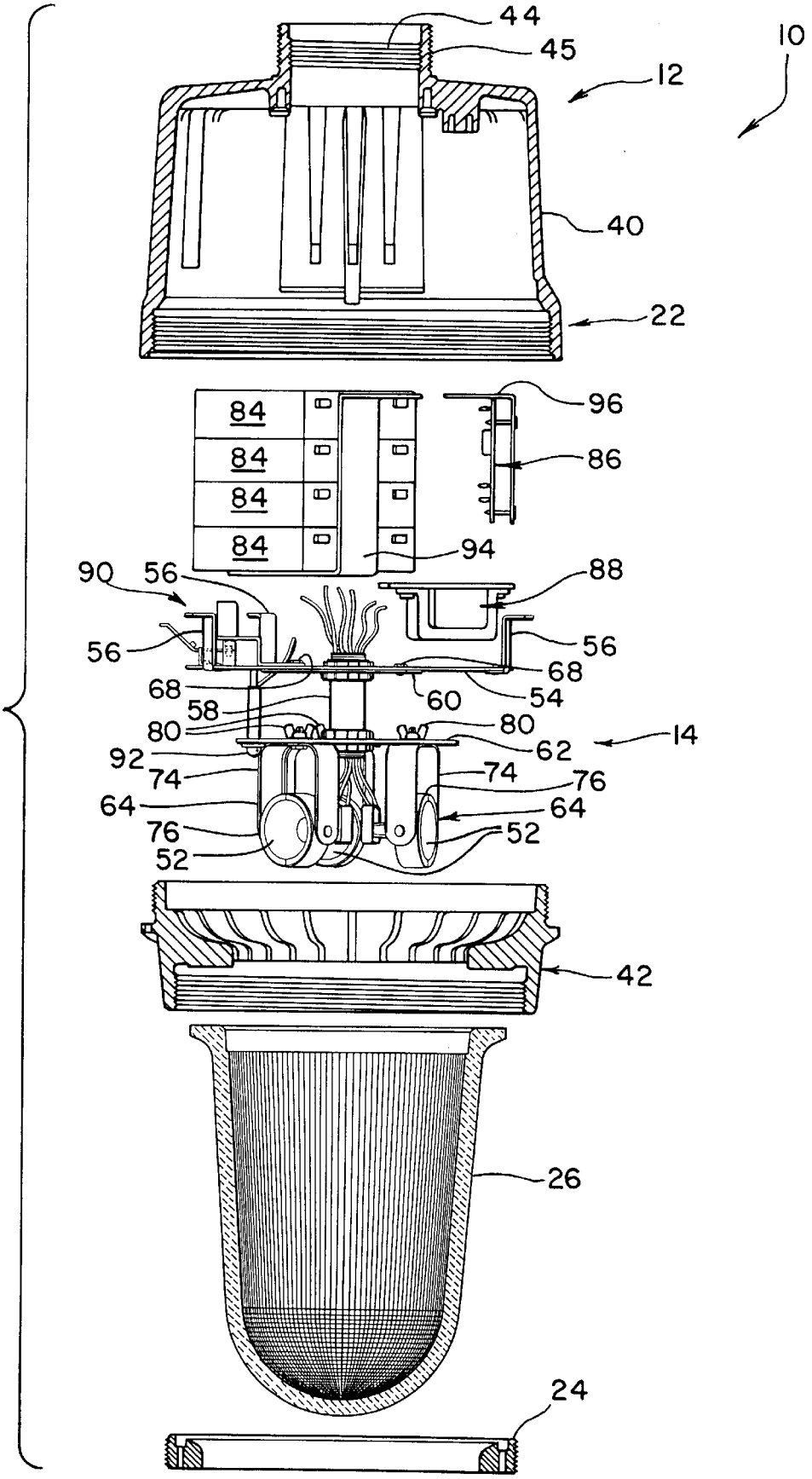
FIG. 2 is an exploded elevational view of the emergency lighting fixture illustrated in FIG. 1 with the housing in cross-section and with certain parts removed for clarity.

As seen in FIGS. 1 and 2, housing 12 includes a mounting cap 20 for supporting lighting fixture 10 and electrically connecting lighting fixture 10 to the external source, a fixture tank 22 releasably coupled to mounting cap 20, a globe mounting ring 24 releasably coupled to fixture tank 22 and a glass globe 26 coupled to fixture tank 22 by globe mounting ring 24. As mentioned above, housing 12 is preferably an explosion proof housing which is especially designed for use in hazardous locations. Housing 12 is designed for unobstructed distribution of light through 360° in the horizontal direction. Accordingly, housing 12 can be utilized to provide a custom emergency lighting to a specific area.

Mounting cap 20 as illustrated in FIG. 1 is designed for pendant mounting of lighting fixture 10 to a conduit carry wires electrically connected to the external power source. Of course, it will be apparent to those skilled in the art from this disclosure that the construction of mounting cap 20 can be modified to be either a wall bracket mounting cap or ceiling mounting cap, since these alternate types of mounting caps are well known in the art. For example, see U.S. Pat. No. 5,379,195 to Epstein which discloses a 90° wall bracket mounting style. The entire disclosure of U.S. Pat. No. 5,379,195 to Epstein is hereby incorporated herein by reference.

As best seen in FIG. 1, mounting cap 20 has an open upper end with a first set of threads 30 for threadedly engaging an electrical conduit (not shown) carrying wires electrically connected to an external power source (not shown), and a lower open end with a second set of threads 32 for threadedly coupling to fixture tank 22. Mounting cap 20 supports housing 12 threading a single electrical conduit into the open upper end of mounting cap 20 via threads 30. Preferably, mounting cap 20 is constructed of cast aluminum with an electrostatically applied epoxy polyester finish baked thereon for high density corrosion protection.

Mounting cap 20 has a first contact block 34 fixedly coupled thereto in a conventional manner. Contact block 34 has a first set of electrical contacts, which are designed to be electrically coupled to the external power wires of the external power source. These first set of contacts are designed electrically to engage a second contact block 36 with a second set of contacts which are electrically coupled to storage power unit 16 and secured to fixture tank 22 to form a wireless connection.

Contact blocks 34 and 36 form a quick disconnect assembly 38 between mounting cap 20 and fixture tank 22 for electrically coupling the external power source to power storage unit 16 by merely threading mounting cap 20 onto fixture tank 22. For example, see U.S. Pat. No. 5,379,195 to Epstein which discloses a similar type of quick disconnect assembly or wireless electrical connection. Accordingly, mounting cap 20 together with the electromechanical male/female contact blocks 34 and 36 of quick disconnect assembly 38 provides for fast and easy installation of the lighting fixture 10 to an external power source.

More specifically, to couple the external power source to emergency lighting fixture 10, the installer merely needs to thread the fixture tank 20 to mounting cap 20 such that the first set of electrical contacts of contact block 34 engage the second set of electrical contacts of contact block 36. Preferably, electrical continuity is not made unless five or more threads are secured between mounting cap 20 and fixture tank 22 to ensure that mounting cap 20 and fixture tank 22 are sufficiently sealed before a spark can occur between the first and second sets of electrical contacts.

Turning now to FIGS. 1 and 2, fixture tank 22 preferably includes an upper half 40 and a lower half 42 releasably coupled together. Upper half 40 and lower half 42 are threadedly coupled together for easy and quick access to lamp unit 14 and power storage unit 16 contained therein. Preferably, Acme double lead threads are used to interconnect upper half 40 to lower half 42 to ensure quick and trouble free assembly and disassembly of fixture tank 22. Upper and lower halves 40 and 42 of fixture tank 22 are both preferably constructed of cast aluminum with less than 0.4 percent copper and has an electrostatically applied epoxy polyester finish baked thereon for high density corrosion protection. Lamp unit 14 and power storage unit 16 are releasably coupled to the interior of fixture tank 22 in a conventional manner such as by screws as discussed below.

As seen in FIG. 2, the upper end of upper half 40 of fixture tank 22 has an open end with a set of internal threads 44 and a set of external threads 45. Internal threads 44 threadedly engage second contact block 36 for securing contact block 36 thereto and for closing off the upper end of housing 12. External threads 45 threadedly engage threads 32 of mounting cap 20 for securing mounting cap 20 thereto.

Globe mounting ring 24 is designed to be releasably secured to the bottom end of lower half 42 of fixture tank 22 for securing glass globe 26 thereto. Preferably, the threads between globe mounting ring 24 and lower half 42 of fixture tank 22 are Acme double lead threads, which are designed to provide quick and trouble free assembly and a disassembly therebetween. Globe mounting ring 24 is preferably constructed of cast aluminum with less than 0.4 percent copper, and has an electrostatically applied epoxy polyester finish baked thereon for high density corrosion protection.

Glass globe 26 is constructed of a transparent material such as a clear, tempered sodium lime glass, which is prestressed for heat and impact resistance. Globe 26 is preferably capable of withstanding a minimum of 500 psi hydrostatic pressure and a thermal shock differential of 210° C. Moreover, globe 26 should be able to pass an impact test using a four pound steel ball with a one inch diameter impacting globe 26 from a distance of six inches at the very bottom point of globe 26. Preferably, the internal surface of globe 26 is fluted on its sides and prismatic on its bottom to diffuse the light being transmitted therethrough by lamp unit 14.

Figure 5:
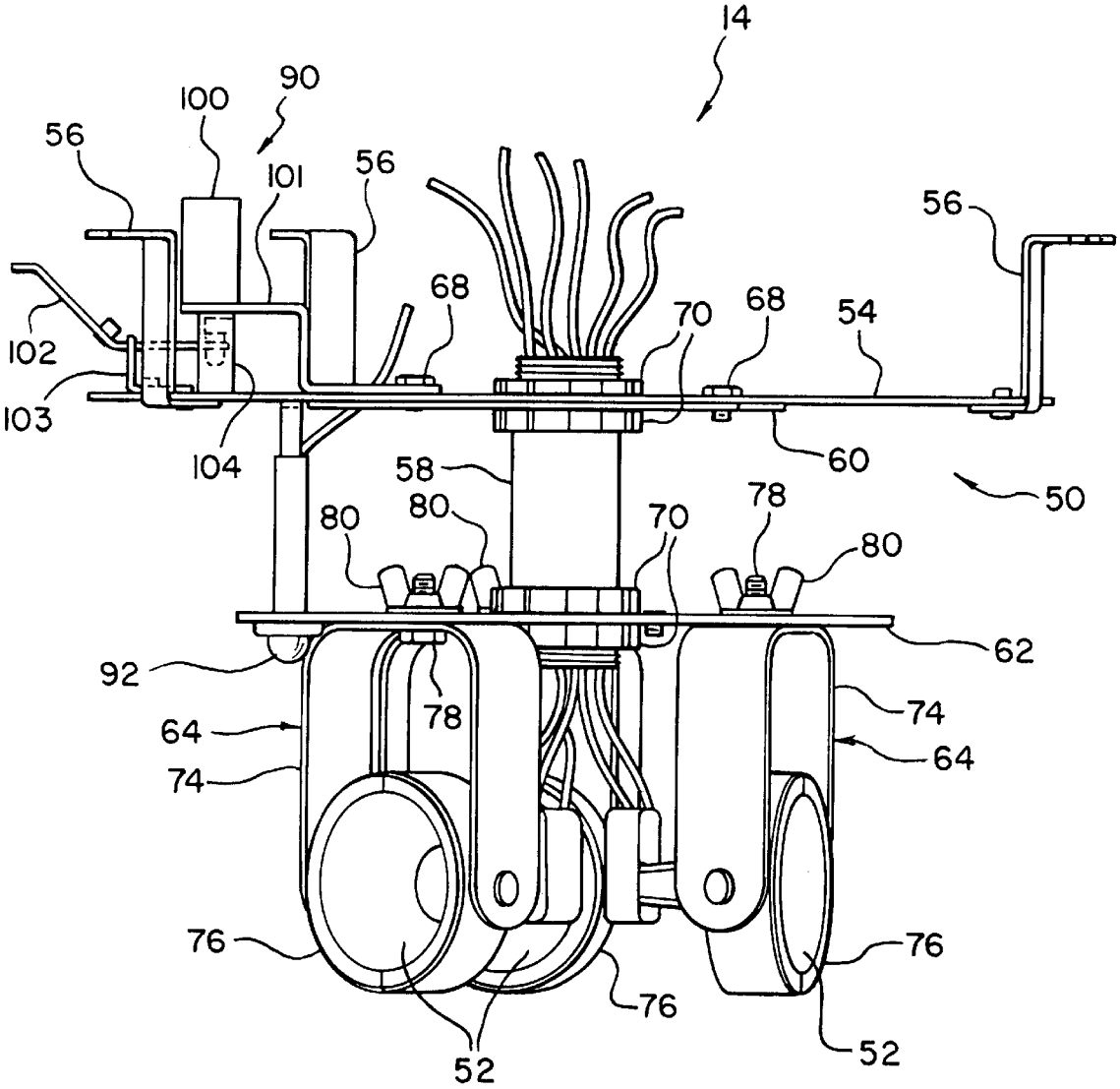
FIG. 5 is an elevational view of the lamp unit removed from the housing for use in the emergency lighting fixture illustrated in FIGS. 1–4 in accordance with the present invention.
Figure 6:
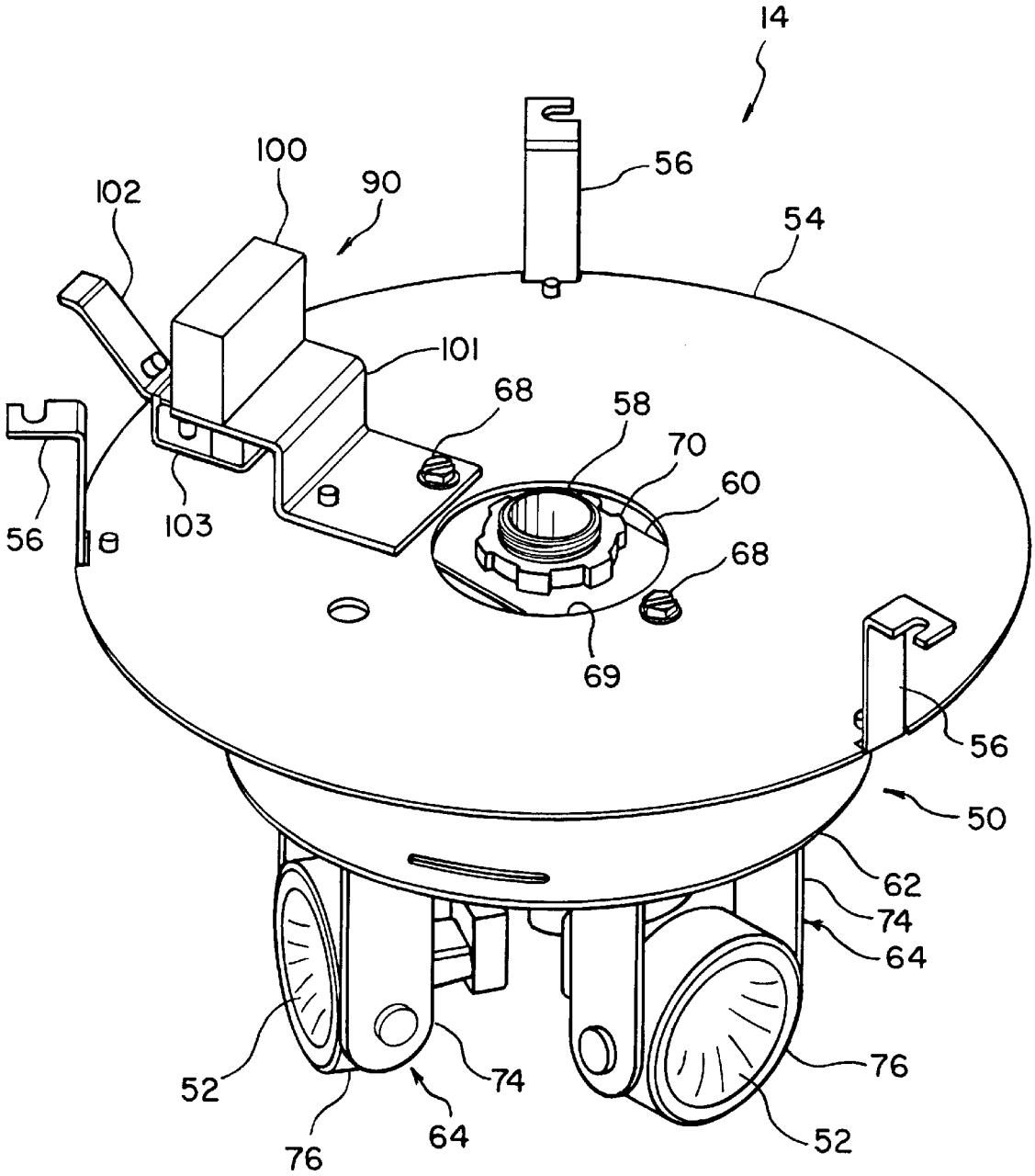
FIG. 6 is a top perspective view of the lamp unit illustrated in FIG. 5 for use with the emergency lighting fixture illustrated in FIGS. 1–4 in accordance with the present invention.

Referring now to FIGS. 5 and 6, lamp unit 14 includes a mounting assembly 50 with three high intensity lamps 52, which is coupled to the interior of fixture tank 22. Mounting assembly 50 has a circular reflector 54 with three mounting brackets 56, a wiring conduit 58 coupled to reflector 54 by an adapter plate 60, a circular mounting plate 62 coupled to the lower end of wiring conduit 58 and a lamp holder 64 coupled to mounting plate 62 for adjustably supporting lamps 52.

Figure 3:
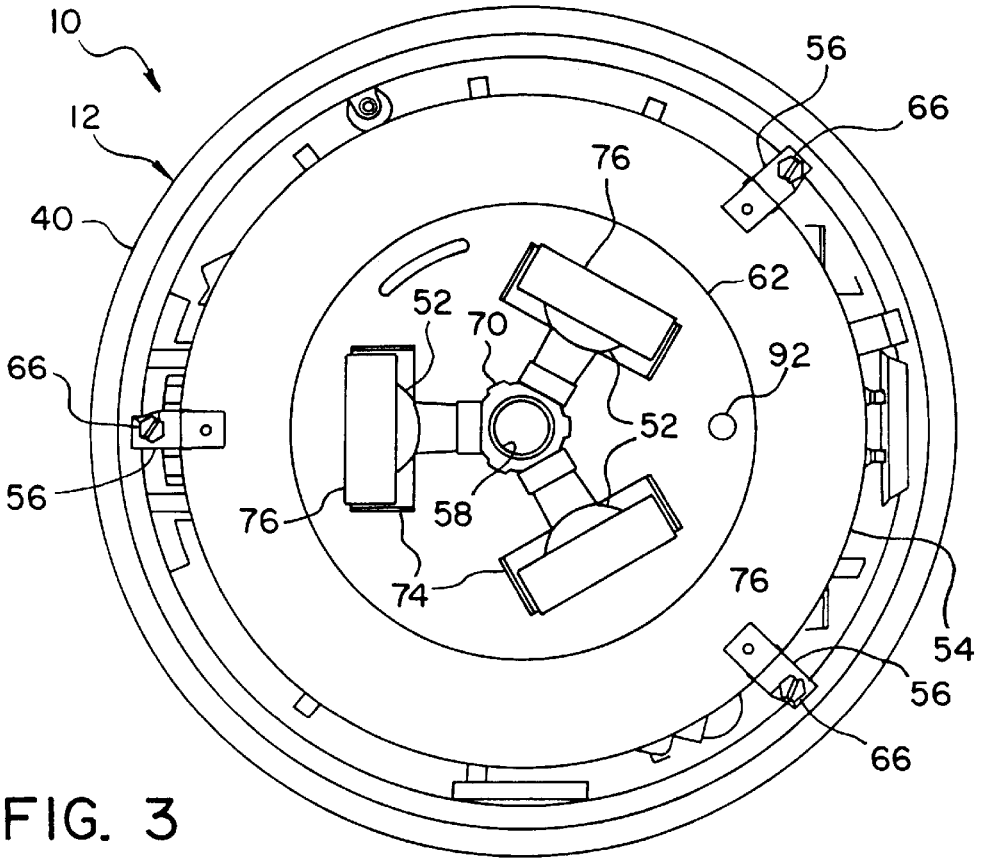
FIG. 3 is a bottom plan view of the emergency lighting fixture illustrated in FIGS. 1 and 2 with the glass globe and the globe mounting ring removed.
Figure 4:
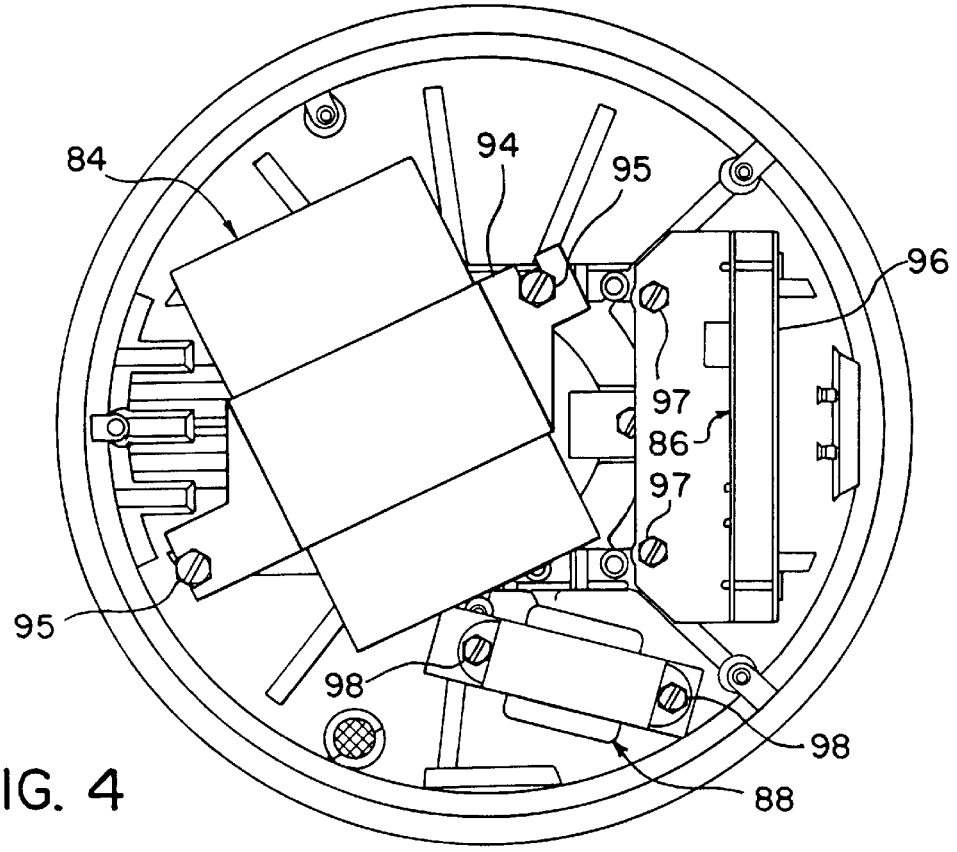
FIG. 4 is a bottom plan view of the emergency lighting fixture illustrated in FIGS. 1–3 with the lamp unit, the glass globe and the globe mounting ring removed from the housing to illustrate the power storage unit.

As seen in FIG. 3, lamp unit 14 is releasably coupled to the interior of fixture tank 22 by three screws 66, which engage the three mounting brackets 56 extending from reflector 54. Reflector 54 is designed to reflect any incidental light from lamps 52 downwardly and through globe 26. Reflector 54 is preferably constructed of a substantially rigid material such as a sheet metal.

As best seen in FIGS. 5 and 6, reflector 54 is coupled to mounting plate 62 via wire conduit 58 and adapter plate 60. In particular, adapter plate 60 is preferably a rectangular metal plate with a central opening for fixedly receiving wiring conduit 58 therein and a pair of threaded holes for releasably coupling adapter plate 60 to reflector 54 via screws 68 so that wiring conduit 58 is aligned with a central opening 69 formed in reflector 54.

Wiring conduit 58 is preferably a rigid metallic tube having its ends threaded so that each end receives a pair of sealing locknuts 70 thereon for connecting one end of wiring conduit 58 to adapter plate 60 and the other end of wiring conduit 58 to mounting plate 62. The electrical wires for energizing lamps 52 pass through wiring conduit 58 from fixture tank 22 down to lamps 52 positioned within globe 26.

Mounting plate 62 is preferably a circular metal plate having a central opening for fixedly coupling one end of wiring conduit 58 thereto via a pair of sealing locknuts 70. Mounting plate 62 also has three mounting holes, which are spaced 120° apart for pivotally mounting lamps 52 thereto via lamp holders 64.

In particular, each of the lamp holders 64 includes a U-shaped bracket 74 pivotally coupled to mounting plate 62 about a vertical axis and a gimbal ring 76 pivotally coupled to bracket 74 about a horizontal axis. The vertical direction being substantially parallel to the longitudinal axis of housing 12 extending between mounting cap 20 and glass globe 26, and the horizontal direction being substantially perpendicular to the vertical direction. Each of the brackets 74 is pivotally coupled to mounting plate 62 via a bolt 78 and a wing nut 80 for movement about a vertically extending axis. Accordingly, lamps 52 are adjustable 360° by rotating brackets 74 about vertical axes formed by bolts 78 and nuts 80. This allows lamps 52 to be horizontally adjustable to aim the light transmitted therefrom to specific areas adjacent emergency lighting fixture 10. Since each of the gimbal rings 76 pivotally couple one of the lamps 52 to one of the brackets 74, lamps 52 are also vertically adjustable about horizontal axes for selectively aiming the light transmitted by lamps 52 to specific areas adjacent lighting fixture 10.

Lamps 52 are preferably high intensity lamps such as 20 watt incandescent lamps of the MR16 type. Lamps 52 are electrically coupled to power storage unit 16 such that lamps 52 are illuminated upon power storage unit 16 sensing a loss of power in the external power source.

It will be apparent to those skilled in the art that lamp holder 64 could be substituted with a ball joint type hinge which articulates to provide movement in the X, Y and Z directions. In other words, it would be apparent to those skilled in the art that various types of conventional mounting assemblies could be utilized to permit lamps 52 to be both independently horizontally and vertically adjustable for aiming the light transmitted therefrom to specific areas external the lighting fixture. Moreover, in certain circumstances, it may be preferable to use a plurality of lamps which are either not independently adjustable, or fixed to reduce costs of manufacturing the lighting fixture.

Figure 7:
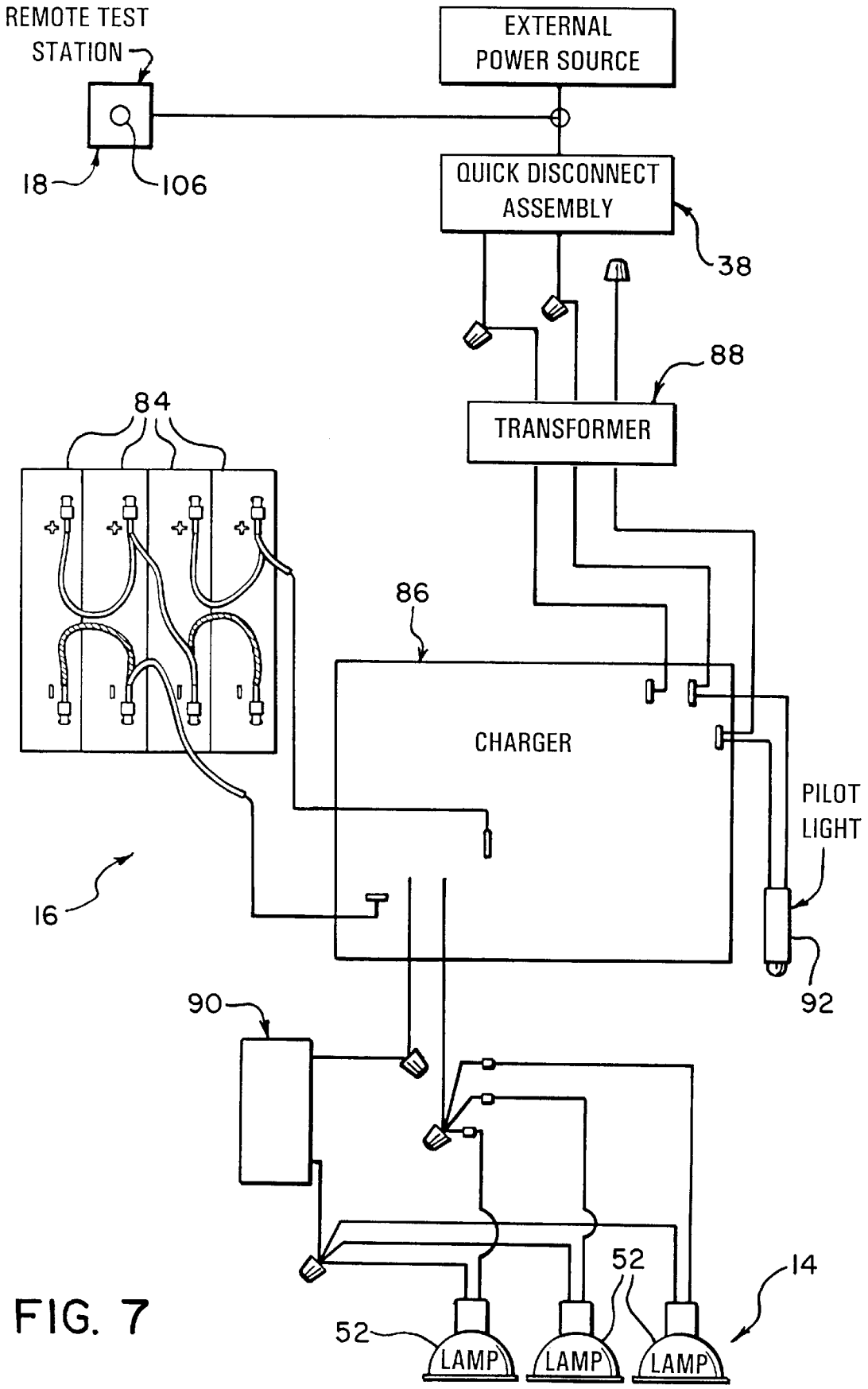
FIG. 7 is a schematic representation of the circuit for the emergency lighting fixture illustrated in FIGS. 1–4 in accordance with the present invention.

Turning now to FIGS. 1, 2 and 7, power storage unit 16 includes four rechargeable batteries 84, a charger 86, a transformer 88, an automatic disconnect assembly 90 and a pilot light 92. Power storage unit 16 is electrically connected to the external power source via the quick disconnect assembly 38 for supplying power to normally energize pilot light 92 and to energize lamps 52 in the event of loss of power to the external power source.

In particular, electrical energy from the external power source enters lighting fixture 10 through the quick disconnect assembly 38 and travels through transformer 88 to step down the voltage of the AC electrical energy from the external power source to charger 86. Charger 86 then selectively supplies DC electrical energy to batteries 84 to maintain batteries 84 at their maximum level of charge. Transformer 88 is also electrically wired to pilot light 92 via charger 86 to supply electrical energy thereto to light pilot light 92 to indicate AC power flow to charger 86. In the event of power loss to the external power source, pilot light 92 will no longer be illuminated. Charger 86, on the other hand, is electrically coupled between batteries 84 and lamps 52 to provide electrical energy to lamps 52 in the event of loss of power to the external power source.

Preferably, there are four long life, lead-acid batteries 84 which require no maintenance and have a 12 VDC output of sixty watts for ninety minutes. In particular, batteries 84 are connected together both in series and in parallel to create the desired output voltage as seen in FIG. 7. The batteries 84 are connected to charger 86 which controls the flow of electrical energy to and from batteries 84.

Charger 86 includes substantially conventional charging circuits and power sensing circuits which are known in prior emergency battery backup lighting fixtures. Accordingly, the details of the circuitry for charger 86 will not be discussed in detail herein. Rather, any conventional circuitry can be utilized so that the charger performs the following functions: (1) converts the AC energy to DC energy for charging batteries 84 to maintain them at maximum charge levels; (2) senses the loss of power from the external power source; (3) controls the flow of electrical energy from battery 84 to lamps 52 in the event of the power loss; and (4) provides an electrical connection between pilot light 92 and the external power source. Of course, it will be apparent to those skilled in the art that circuitry for charger 86 can include additional functions. Moreover, some of these functions could be eliminated and/or provided by other devices or circuitry.

Batteries 84 are releasably coupled to the interior of fixture tank 22 by a U-shaped bracket 94 via a pair of screws 95. Similarly, charger 86 is also coupled to the interior of fixture tank 22 via an L-shaped bracket 96 and a pair of screws 97 in a conventional manner. Transformer 88 is also releasably coupled to the interior of fixture tank 22 by screws 98 in a conventional manner.

Transformer 88 is conventional transformer which is electrically coupled between contact block 36 of quick disconnect assembly 38 and charger 86 by conventional wiring for lowering the voltage supplied to charger 86. Since transformers such as transformer 88 are well known in the art, transformers 88 will not be discussed in detail herein.

Automatic disconnect assembly 90 is designed to automatically disconnect batteries 84 from lamps 52 if the globe is disengaged from the fixture tank 22. Basically, automatic disconnect assembly 90 includes an N.C. contact 100, a contact bracket 101, a pivot arm 102, a pivot bracket 103 and an operator spring 104 as seen in FIG. 6. Automatic disconnect assembly 90 is conventional and well known in the art, and thus, will not be discussed or illustrated in detail herein. More specifically, prior emergency backup fixtures manufactured by Killark Electric Manufacturing Company, a subsidiary of Hubbell Incorporated, utilize similar automatic disconnect assemblies.

Optionally, a remote test station 18 can be provided which allows the user to push a button 106 at a remote location to test the operation of emergency lighting fixture 10 at a convenient ground level location. In particular, upon pushing button 106 of the remote test station 18, power is interrupted from the external power source to simulate a power failure. This will cause lamps 52 to be energized via the electrical energy stored in batteries 84.

Alternate Embodiment

Figure 8:
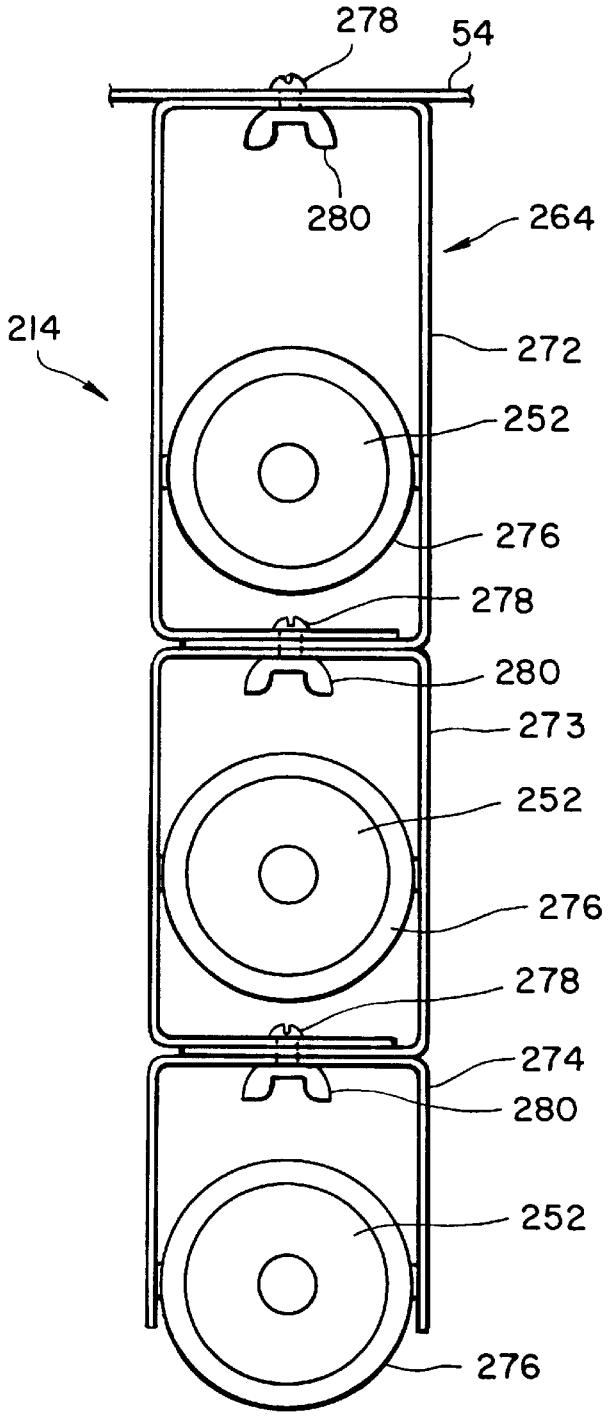
FIG. 8 is an elevational view of an alternate construction for the lamp unit for the emergency lighting fixture of FIGS. 1–4 in accordance with a second embodiment of the present invention.
Figure 9:
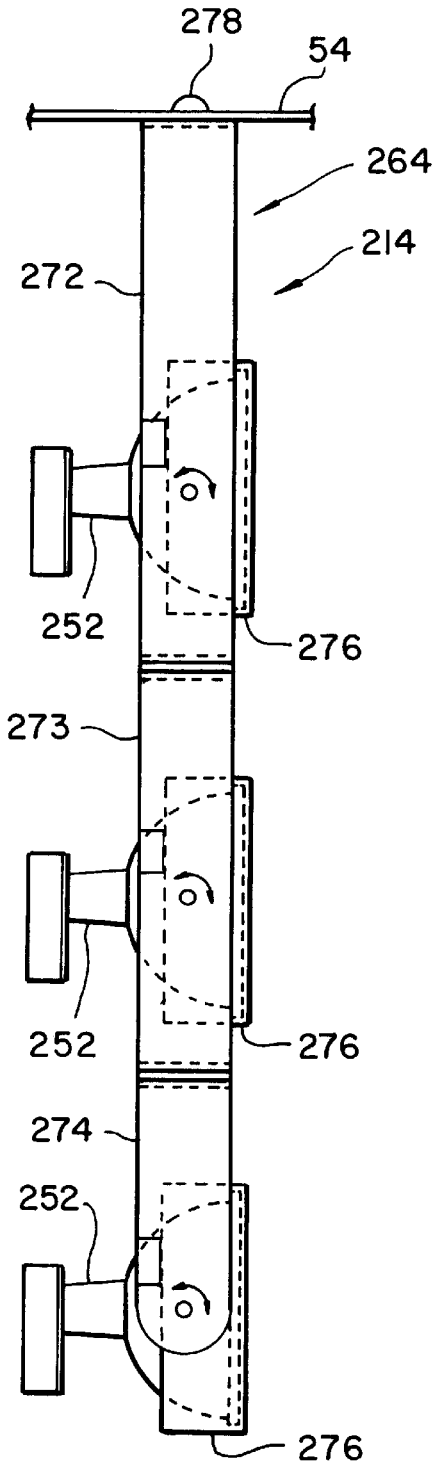
FIG. 9 is a side elevational view of the alternate lamp unit illustrated in FIG. 8 in accordance with the second embodiment of the present invention.

As seen in FIGS. 8 and 9, an alternate lamp unit 214 in accordance with a second embodiment of the present invention is illustrated. Basically, lamp unit 214 is designed to be mounted on reflector 54 of the first embodiment. Of course, there may need to be some minor modification in the first embodiment to accommodate lamp unit 214.

In any event, basically lamp unit 214 has a single lamp holder 264 with three high intensity lamps 252 connected thereto. Lamp holder 264 is pivotally coupled to reflector 54 for movement about a vertical axis. Lamp holder 264 includes a first rectangular bracket 272, a second rectangular bracket 273 and a U-shaped bracket 274 all interconnected via bolts 278 and wing nuts 280 so that brackets 272, 273 and 274 can all independently rotate about a single vertical axis independently of each other. Moreover, each of the brackets 272, 273 and 274 have a gimbal ring 276 pivotally coupled thereto about a horizontal axis such that each of the lamps 252 can be individually adjusted about horizontal axis. Accordingly, lamp unit 214 has three lamps 252 which can be independently adjusted both horizontally and vertically to provide custom emergency lighting to specific areas adjacent the lighting fixture.

While only two embodiments have been chosen to illustrate the invention, it will be understood by those skilled in the art that various changes and modifications can be made herein without departing from the scope of the invention as defined in the appended claims.

What is claimed is:

1. An emergency lighting fixture for providing light in response to loss of power, comprising:

a housing with a transparent section for allowing light to pass therethrough, and a mounting structure to mount said housing to a support, said housing having first central axis extending through said transparent section and said mounting structure;

a first lamp movably mounted within said housing for adjustably aiming light transmitted by said first lamp through said transparent section of said housing and towards a first specific external area, said first lamp being coupled to said housing for movement in two rotational directions by a mounting assembly, which is coupled to said first lamp and to said housing, said mounting assembly comprising a mounting plate coupled to said housing and a first mounting bracket pivotally coupled directly to said mounting plate by a first pivoting member, which enables pivoting of said first mounting bracket relative to said mounting plate about a second axis, said first lamp being pivotally coupled to said first mounting bracket by a first pivoting element, which enables pivoting of said first lamp relative to said first bracket and said mounting plate;

a second lamp movably mounted within said housing for adjustably aiming light transmitted by said second lamp through said transparent section of said housing and towards a second specific external area, said second lamp being coupled to said mounting plate for movement in two rotational directions by a second bracket pivotally coupled directly to said mounting plate by a second pivoting member, which enables pivoting of said second mounting bracket relative to said mounting plate and said first mounting bracket about a third axis, said second lamp being pivotally coupled to said second mounting bracket by a second pivoting element, which enables pivoting of said second lamp relative to said first bracket, said first lamp, said second bracket, and said mounting plate; and a power storage unit with emergency backup power stored therein for energizing said lamp in response to loss of power being electrically coupled to said first lamp and adapted to be electrically coupled to an external power source.

2. An emergency lighting fixture according to claim 1, further comprising a third lamp movably mounted within said housing for adjustably aiming light transmitted by said third lamp through said housing and towards a third specific external area.

3. An emergency lighting fixture according to claim 2, wherein said first, second and third lamps are spaced approximately 120° apart.

4. An emergency lighting fixture according to claim 3, wherein said transparent section extends approximately 360° around said first central axis.

5. An emergency lighting fixture according to claim 4, wherein said transparent section is constructed of a heat and impact resistant material, and said housing includes a fixture tank coupled to said transparent section to form an explosion proof enclosure.

6. An emergency lighting fixture according to claim 5, wherein said fixture tank has said power storage unit mounted therein.

7. An emergency lighting fixture according to claim 6, wherein said power storage unit includes at least one battery coupled to a charger.

8. An emergency lighting fixture according to claim 7, wherein said power storage unit includes a pilot light.

9. An emergency lighting fixture according to claim 1, further comprising a remote test switch electrically coupled to said power storage unit and mounted in an enclosure separate from said housing for remotely operating said power storage unit to energize said first lamp via a battery mounted with said housing.

10. An emergency lighting fixture according to claim 1, wherein said housing further includes a fixture tank with a first set of electrical contacts electrically coupled to said power storage unit, and said mounting structure of said housing includes a mounting cap with a second set of electrical contacts, said mounting cap being releasably coupled to said fixture tank such that said first set of contacts selectively engage and disengage said second set of contacts upon coupling and uncoupling of said mounting cap to said fixture tank.

11. An emergency lighting fixture according to claim 10, wherein said mounting cap has a first set of threads for threadedly engaging a second set of threads on said fixture tank.

12. An emergency lighting fixture according to claim 11, wherein said transparent section is constructed of a heat and impact resistant material, and coupled to said fixture tank to form an explosion proof section.

13. An emergency lighting fixture according to claim 1, wherein said first central axis and said third axis are spaced.

14. An emergency lighting fixture for providing light in response to loss of power, comprising:

a housing with a transparent section for allowing light to pass therethrough, and mounting structure to mount said housing to a support, said housing having a first central axis extending through said transparent section and said mounting structure;

a first lamp having first mounting means coupled thereto for movably mounting said first lamp to said housing and for adjustably aiming light transmitted by said first lamp through said transparent section of said housing and towards a first specific external area, said first mounting means permitting said lamp to move about a second axis which is substantially perpendicular to said first central axis and about a third axis, which extends in the same direction as said first central axis; and a power storage unit with emergency backup power stored therein for energizing said lamp in response to loss of power being electrically coupled to said first lamp and adapted to be electrically coupled to an external power source.

15. An emergency for providing light in response to loss of power, comprising:

a housing with a transparent section for allowing light to pass therethrough, and mounting structure to mount said housing to a support, said housing having a first central axis extending through said transparent section and said mounting structure;

a first lamp having first mounting means coupled thereto for movably mounting said first lamp to said housing and for adjustably aiming light transmitted by said first lamp through said transparent section of said housing and towards a first specific external area, said first mounting means permitting said lamp to move without the use of a motor about both a second axis which is substantially perpendicular to said first central axis, and a third axis, which extends in the same direction as said first central axis; and a power storage unit with emergency backup power stored therein for energizing said lamp in response to loss of power being electrically coupled to said first lamp and adapted to be electrically coupled to an external power source.

16. An emergency lighting fixture according to claim 15, wherein said first central axis and said third axis are spaced.

17. An emergency lighting fixture for providing light in response to loss of power external to the device, comprising:

a housing with a transparent section for allowing light to pass therethrough, and mounting structure to mount said housing to a support, said housing having first central axis extending through said transparent section and said mounting structure;

a first lamp movably mounted within said housing for adjustably aiming light transmitted by said first lamp through said transparent section of said housing and towards a first specific external area, said first lamp being pivotally mounted within said housing about a second axis, which is substantially perpendicular to said first central axis, and a third axis, which extends in the same direction as and is spaced from said first central axis, by a mounting assembly, said mounting assembly being coupled to said first lamp and to said housing.

18. An emergency lighting fixture according to claim 17, wherein said mounting assembly includes a mounting plate fixedly coupled to said housing, and a first mounting bracket pivotally coupled to said mounting plate about said third axis, said first lamp being pivotally coupled to said first mounting bracket about said second axis.

19. An emergency lighting fixture according to claim 18, further comprising a second lamp movably mounted within said housing by said mounting assembly, which is coupled to said second lamp and to said housing.

20. An emergency lighting fixture according to claim 19, wherein said mounting assembly includes a second mounting bracket pivotally coupled to said mounting plate about a fourth axis, and said second lamp being pivotally coupled to said second mounting bracket about a fifth axis.

21. An emergency lighting fixture according to claim 20, further comprising a third lamp pivotally coupled to said mounting plate about a sixth axis by a third mounting bracket, and said third lamp being pivotally coupled to said third mounting bracket about a seventh axis.

22. An emergency lighting fixture according to claim 21, wherein each of said fourth and six axes are spaced from said third axis, and said fifth and seventh axes are substantially perpendicular to said fourth and six axes, respectively.

23. An emergency lighting fixture for providing light in response to loss of power, comprising:

a housing with a transparent section for allowing light to pass therethrough, and mounting structure to mount said housing to a support, said housing having first central axis extending through said transparent section and said mounting structure;

a first lamp movably mounted within said housing for adjustably aiming light transmitted by said first lamp through said transparent section of said housing and towards a first specific external area, said first lamp being pivotally mounted within said housing about a second axis, which is substantially perpendicular to said first central axis, and a third axis, which extends in the same direction as said first central axis, by a mounting assembly, said mounting assembly being coupled to said first lamp and to said housing, said mounting assembly including a mounting plate fixedly coupled to said housing, and a first mounting bracket pivotally coupled to said mounting plate about said third axis, said first lamp being pivotally coupled to said first mounting bracket about said second axis, a second lamp movably mounted within said housing by said mounting assembly, which is coupled to said second lamp and to said housing, said second lamp being pivotally coupled to said first mounting bracket for pivotally moving about said third axis and a fourth axis that is substantially parallel to said second axis.

24. An emergency lighting fixture according to claim 23, wherein said mounting assembly includes a second mounting bracket pivotally coupled to said first mounting bracket about said third axis, said second lamp being pivotally coupled to said second mounting bracket about said third and fourth axes.

25. An emergency lighting fixture for providing light in the event of loss of power, comprising:

a housing with a transparent section for allowing light to pass therethrough, and mounting structure to mount said housing to a support, said housing having a first central axis extending through said transparent section and said mounting structure;

a plurality of lamps mounted within said housing to a single mounting plate for transmitting light through said transparent section of said housing to illuminate specific external areas, each of said lamps being independently coupled for independent movement relative to each other in a first direction, which is substantially perpendicular to said first central axis, by a mounting bracket, said mounting bracket being coupled to its respective said lamp and to said mounting plate, each of said mounting brackets being coupled to said mounting plate only by a single threaded fastener with a threaded retaining element adjustably secured to said threaded fastener, with said threaded fastener being separated from said threaded retaining element by said mounting plate; and a power storage unit electrically coupled to said lamps for supplying emergency backup power thereto, and adapted to be electrically coupled to an external power supply to detect the loss of power being transmitted to said power storage unit.

26. An emergency lighting fixture for providing light in the event of loss of power, comprising:

a housing with a transparent section for allowing light to pass therethrough, and mounting structure to mount said housing to a support, said housing having a first central axis extending through said transparent section and said mounting structure;

a plurality of lamps, each of said plurality of lamps having a mounting means, respectively, for coupling said respective lamp to said housing, each mounting means independently movably mounting said respective lamp about a second axis, which is substantially perpendicular to said first central axis, and a third axis, which is substantially perpendicular to said second axis and for transmitting light through said transparent section of said housing to illuminate a specific external area, each of said mounting means being independently coupled to said housing and securing said respective lamp for independent movement relative to each of said other of said mounting means and each of said other respective lamps such that each lamp can illuminate different specific external areas; and a power storage unit electrically coupled to said lamps for supplying emergency backup power thereto, and adapted to be electrically coupled to an external power supply to detect the loss of power being transmitted to said power storage unit.

27. An emergency lighting fixture for providing light in the event of loss of power, comprising:

a housing with a transparent section for allowing light to pass therethrough, and mounting structure to mount said housing to a support, said housing having a first central axis extending through said transparent section and said mounting structure;

a plurality of lamps, each of said plurality of lamps having a mounting means, respectively, for coupling said respective lamp to said housing, each mounting means independently movably mounting said respective lamp about a second axis, which is substantially perpendicular to said first central axis, and a third axis, which is substantially perpendicular to said second axis and for transmitting light through said transparent section of said housing to illuminate a specific external area, each of said mounting means being independently coupled to said housing and securing said respective lamp for independent movement relative to each of said other of said mounting means and each of said other respective lamps without the use of a motor such that each lamp can illuminate different specific external areas; and a power storage unit electrically coupled to said lamps for supplying emergency backup power thereto, and adapted to be electrically coupled to an external power supply to detect the loss of power being transmitted to said power storage unit.

28. An emergency lighting fixture for providing light in the event of loss of power, comprising:

a housing with a transparent section for allowing light to pass therethrough, and mounting structure to mount said housing to a support;

a plurality of lamps mounted within said housing to a mounting plate for transmitting light through said transparent section of said housing to illuminate specific external areas, each of said lamps being independently coupled for independent movement relative to each other by a mounting bracket, which is coupled to its respective said lamp and to said mounting plate, each of said mounting brackets being coupled to said mounting plate by a pivoting means, each said pivot means enabling its respective said mounting bracket to pivot independently from other pivoting means; and a power storage unit electrically coupled to said lamps for supplying emergency backup power thereto.

29. An emergency lighting fixture according to claim 28, wherein said transparent section is constructed of a heat and impact resistant material, and said housing includes a fixture tank coupled to said transparent section to form an explosion proof enclosure.

30. An emergency lighting fixture according to claim 29, wherein said fixture tank has said power storage unit mounted therein.

31. An emergency lighting fixture according to claim 30, wherein said power storage unit includes at least one battery coupled to a charger.

32. An emergency lighting fixture according to claim 31 wherein said power storage unit includes a pilot light.

33. An emergency lighting fixture according to claim 28, wherein said housing further includes a fixture tank with a first set of electrical contacts electrically coupled to said power storage unit, and said mounting structure of said housing includes a mounting cap with a second set of electrical contacts adapted to be coupled to a external power source, said mounting ca being releasably coupled to said fixture tank such that said first set of contacts selectively engage and disengage said second set of contacts upon coupling and uncoupling of said mounting cap to said fixture tank.

34. An emergency lighting fixture according to claim 33, wherein said mounting cap has a first set of threads for threadedly engaging a second set of threads on said fixture tank.

35. An emergency lighting fixture according to claim 34, wherein said transparent section is constructed of a heat and impact resistant material, and coupled to said fixture tank to form an explosion proof section.

36. An emergency lighting fixture according to claim 35, wherein said fixture tank has said power storage unit mounted therein.

37. An emergency lighting fixture according to claim 36 wherein said power storage unit includes at least one battery coupled to a charger.

38. An emergency lighting fixture according to claim 37, wherein said power storage unit includes a pilot light.

39. An emergency lighting fixture according to claim 36, wherein said housing has a first central axis extending through said transparent section and said mounting structure, said lamps are each independently coupled for independent movement in first and second directions by a mounting assembly, which is coupled to said lamps and to said housing, said first direction being substantially perpendicular to said first central axis and said second direction being substantially parallel to said first central axis.

40. An emergency lighting fixture according to claim 39, wherein a remote test switch mounted in an enclosure separate from said housing for remotely operating said power storage unit to energize said lamps via a battery mounted with said housing.

41. An emergency lighting fixture according to claim 28, wherein a remote test switch electrically coupled to said power storage unit and mounted in an enclosure separate from said housing for remotely operating said power storage unit to energize said lamps via a battery mounted with said housing.

* * * * *